US009335648B2

(12) United States Patent
Mizobe

(10) Patent No.: US 9,335,648 B2
(45) **Date of Patent: *May 10, 2016**

(54) ELECTROSTATIC LATENT IMAGE DEVELOPING TONER

(71) Applicant: KYOCERA Document Solutions Inc., Osaka (JP)

(72) Inventor: Takeo Mizobe, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 10 days.

This patent is subject to a terminal disclaimer.

(21) Appl. No.: 14/444,094

(22) Filed: Jul. 28, 2014

(65) Prior Publication Data

US 2015/0037724 A1 Feb. 5, 2015

(30) Foreign Application Priority Data

Jul. 31, 2013 (JP) ..... 2013-158642

(51) Int. Cl.
*G03G 9/08* (2006.01)
*G03G 9/093* (2006.01)

(52) U.S. Cl.
CPC ..... *G03G 9/09328* (2013.01); *G03G 9/09314* (2013.01); *G03G 9/09357* (2013.01); *G03G 9/09392* (2013.01)

(58) Field of Classification Search
CPC ..... G03G 9/09314
USPC ..... 430/110.2
See application file for complete search history.

(56) References Cited

U.S. PATENT DOCUMENTS

2005/0271964 A1 12/2005 Etou et al.

FOREIGN PATENT DOCUMENTS

JP 2004-138985 A 5/2004
JP 2004-294468 A 10/2004
JP 2004-294469 A 10/2004

OTHER PUBLICATIONS

An Office Action; "Notice of Reasons for Rejection," issued by the Japanese Patent Office on Jun. 30, 2015, which corresponds to Japanese Patent Application No. 2013-158642 and is related to U.S. Appl. No. 14/444,094.

*Primary Examiner* — Mark A Chapman
(74) *Attorney, Agent, or Firm* — Studebaker & Brackett PC

(57) ABSTRACT

An electrostatic latent image developing toner of the present disclosure contains a toner particle including a toner core containing a binder resin, and a shell layer coating a surface of the toner core. The shell layer is constituted by a resin containing a thermosetting resin. A zeta potential of the toner core measured in an aqueous medium adjusted to pH 4 is negative, and a zeta potential of the toner particle measured in an aqueous medium adjusted to pH 4 is positive. A pH at which the zeta potential of the toner particle measured in an aqueous medium is zero is 4.5 or higher and 7.0 or lower.

9 Claims, 3 Drawing Sheets

ELECTROSTATIC LATENT IMAGE DEVELOPING TONER

INCORPORATION BY REFERENCE

The present application claims priority under 35 U.S.C. §119 to Japanese Patent Application No. 2013-158642, filed Jul. 31, 2013. The contents of this application are incorporated herein by reference in their entirety.

BACKGROUND

The present disclosure relates to an electrostatic latent image developing toner including toner particles.

In a technical field relating to image formation (such as a copying machine), an electrostatic latent image developing toner is fixed on a recording medium (such as paper) through application of heat and pressure by using a fixing roller or the like. Regarding this fixing operation, there are demands for energy saving in the fixing operation and compactness of a fixing device. Therefore, a toner that can be satisfactorily fixed on a recording medium at a lower temperature than in the conventional technique is desired. Besides, in order to obtain a toner that can be satisfactorily fixed at a low temperature, a production method for a toner using a binder resin having a low melting point (or a binder resin having a low glass transition point), or a mold release agent having a low melting point has been proposed. When such a toner is stored at a high temperature, however, there arises a problem that toner particles included in the toner are easily aggregated. The charge amount of the aggregated toner particles is easily lowered as compared with the charge amount of toner particles not aggregated. Accordingly, in an image formed by fixing aggregated toner particles on a recording medium, an image defect occurs in some cases.

As a countermeasure, a toner including toner particles having a core-shell structure has been proposed for purpose of improving the fixability of a toner in a low temperature region (low-temperature fixability) and the storage stability of a toner at a high temperature (high-temperature preservability) and inhibiting the blocking property of a toner. In the toner particles having the core-shell structure, a toner core containing a binder resin having a low melting point is coated with a shell layer. A resin constituting the shell layer has a glass transition point higher than the glass transition point of the binder resin contained in the toner core.

As a toner particle having the core-shell structure, a toner particle in which the surface of a toner core is coated with a thin film containing a thermosetting resin has been proposed. This toner core has a softening temperature of 40° C. or more and 150° C. or less.

SUMMARY

An electrostatic latent image developing toner of the present disclosure includes a toner particle including a toner core containing a binder resin and a shell layer coating a surface of the toner core. A resin constituting the shell layer contains a thermosetting resin. A zeta potential of the toner core measured in an aqueous medium adjusted to pH 4 is negative. A zeta potential of the toner particle measured in an aqueous medium adjusted pH 4 is positive. A pH at which the zeta potential of the toner particle measured in an aqueous medium is zero is 4.5 or higher and 7.0 or lower.

DETAILED DESCRIPTION

An embodiment of the present disclosure will now be described in detail. It is noted that the present disclosure is not limited to the following embodiment at all but can be practiced with appropriate modifications made within the scope of the object of the present disclosure. Incidentally, redundant description will be appropriately omitted in some cases in the following, which does not limit the gist of the present disclosure.

A toner according to the present embodiment is an electrostatic latent image developing toner. Each toner particle included in the toner contains a toner core and a shell layer coating the toner core. The toner core contains a binder resin. The toner core is anionic, and the shell layer is cationic.

The toner particle will now be described with reference to FIG. 1.

Figure 1:
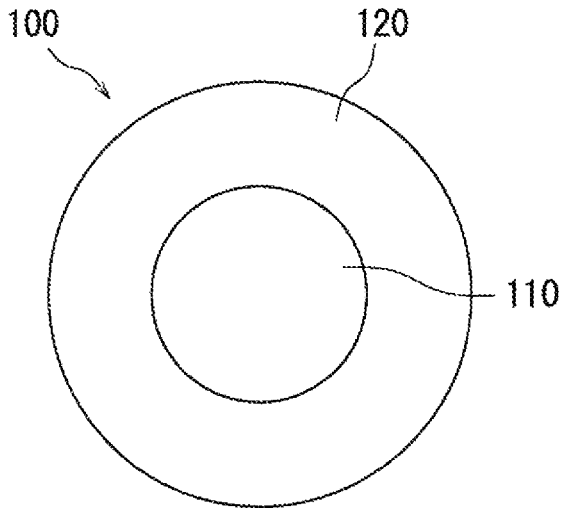
FIG. 1 is a schematic diagram of a toner particle included in an electrostatic latent image developing toner according to an embodiment of the present disclosure.

In FIG. 1, the toner particle 100 contains the toner core 110 and the shell layer 120. The toner core 110 contains a binder resin. The shell layer 120 is formed to coat the surface of the toner core 110, and is constituted from a resin containing a thermosetting resin.

Components of the toner core 110 will now be described.

The binder resin is an indispensable component of the toner core 110, and is anionic. The binder resin has, for example, an ester group, a hydroxyl group, a carboxyl group, an amino group, an ether group, an acid group, or a methyl group as a functional group. As the binder resin, a resin having, in a molecule thereof, a functional group such as a hydroxyl group, a carboxyl group, or an amino group is preferred, and a resin having, in a molecule thereof, a hydroxyl group and/or a carboxyl group is more preferred. This is because such a functional group reacts with and is chemically bonded to a unit (such as methylol melamine) derived from a monomer of the thermosetting resin contained in the resin constituting the shell layer. As a result, in the toner particle 100 produced by using the binder resin having such a functional group, the shell layer 120 and the toner core 110 are strongly bonded to each other.

If the binder resin has a carboxyl group, for attaining a sufficient anionic property, the binder resin has an acid value of preferably 3 mgKOH/g or more and 50 mgKOH/g or less, and more preferably 10 mgKOH/g or more and 40 mgKOH/g or less.

If the binder resin has a hydroxyl group, for attaining a sufficient anionic property, the binder resin has a hydroxyl value of preferably 10 mgKOH/g or more and 70 mgKOH/g or less, and more preferably 15 mgKOH/g or more and 50 mgKOH/g or less.

The solubility parameter (SP value) of the binder resin is preferably 10 or more, and more preferably 15 or more. If the SP value is 10 or more, the wettability of the binder resin to an aqueous medium is improved because its SP value is close to the SP value of water (that is, 23). Therefore, the dispersibility of the binder resin in an aqueous medium can be improved even without using a dispersant, and hence, a dispersion of fine particles of the binder resin described later can be obtained in a homogeneous form.

Specific examples of the binder resin include thermoplastic resins (such as styrene-based resins, acrylic-based resins, styrene acrylic-based resins, polyethylene-based resins, polypropylene-based resins, vinyl chloride-based resins, polyester resins, polyamide-based resins, polyurethane-based resins, polyvinyl alcohol-based resins, vinyl ether-based resins, N-vinyl-based resins, and styrene-butadiene-based resins). For improving the dispersibility of a colorant in the toner, the chargeability of the toner, or the fixability of the toner on a recording medium, a styrene-acrylic-based resin and/or a polyester resin is preferably used as the binder resin.

A styrene acrylic-based resin is a copolymer of a styrene-based monomer and an acrylic-based monomer. Specific examples of the styrene-based monomer include styrene, α-methylstyrene, p-hydroxystyrene, m-hydroxystyrene, vinyl toluene, α-chlorostyrene, o-chlorostyrene, m-chlorostyrene, p-chlorostyrene, and p-ethylstyrene.

Specific examples of the acrylic-based monomer include (meth)acrylic acid; (meth)acrylic acid alkyl ester (such as methyl(meth)acrylate, ethyl(meth)acrylate, n-propyl(meth)acrylate, iso-propyl(meth)acrylate, n-butyl(meth)acrylate, iso-butyl(meth)acrylate, and 2-ethylhexyl(meth)acrylate); and (meth)acrylic acid hydroxyalkyl ester (such as 2-hydroxyethyl(meth)acrylate, 3-hydroxypropyl(meth)acrylate, 2-hydroxypropyl(meth)acrylate, and 4-hydroxypropyl (meth)acrylate).

In preparation of the styrene acrylic-based resin, a hydroxyl group can be introduced into the styrene acrylic-based resin by using a monomer having a hydroxyl group (such as p-hydroxystyrene, m-hydroxystyrene, or hydroxyalkyl(meth)acrylate). By appropriately adjusting the amount of the monomer having a hydroxyl group to be used, the hydroxyl value of the resultant styrene acrylic-based resin can be adjusted.

In preparation of the styrene acrylic-based resin, a carboxyl group can be introduced into the styrene acrylic-based resin by using (meth)acrylic acid as a monomer. By appropriately adjusting the amount of the (meth)acrylic acid to be used, the acid value of the resultant styrene acrylic-based resin can be adjusted.

A polyester resin is obtained by condensation polymerization or co-condensation polymerization of, for example, a bivalent, trivalent, or higher valent alcohol component and a bivalent, trivalent, or higher valent carboxylic acid component.

Examples of the bivalent alcohol component used for synthesizing the polyester resin include diols (such as ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol); and bisphenols (such as bisphenol A, hydrogenated bisphenol A, polyoxyethylene-modified bisphenol A, and polyoxypropylene-modified bisphenol A).

Examples of the trivalent or higher alcohol component used for synthesizing the polyester resin include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, digylcerol, 2-methyl propanetriol, 2-methyl-1,2,4-butanetriol, trimethylolethane, trimethylolpropane, and 1,3,5-trihydroxymethylbenzene.

Examples of the bivalent carboxylic acid component used in synthesizing the polyester resin include maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, and alkyl succinic acid or alkenyl succinic acid (such as n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid, or isododecenyl succinic acid).

Examples of the trivalent or higher valent carboxylic acid component used in synthesizing the polyester resin include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxy propane, 1,2,4-cyclohexanetricarboxylic acid, tetra(methylenecarboxyl)methane, 1,2,7,8-octanetetracarboxylic acid, pyromellitic acid, and Empol trimer acid.

Furthermore, any of the aforementioned carboxylic acid components may be used in the form of, for example, an ester-forming derivative (such as an acid halide, an acid anhydride, or a lower alkyl ester). Here, a "lower alkyl" means an alkyl group having 1 to 6 carbon atoms.

The acid value and the hydroxyl value of the polyester resin can be adjusted by appropriately changing the amount of the bivalent, trivalent or higher valent alcohol component and the amount of the bivalent, trivalent or higher valent carboxylic acid component to be used in producing the polyester resin. Besides, the acid value and the hydroxyl value of the polyester resin tend to be lowered by increasing the molecular weight of the polyester resin.

In order to achieve carbon neutral status, the toner preferably contains a biomass-derived material. Specifically, the ratio of biomass-derived carbon in entire carbon contained in the toner is preferably 25% by mass or more and 90% by mass or less.

As the binder resin, a polyester resin synthesized from a biomass-derived alcohol (such as 1,2-propanediol, 1,3-propanediol, or glycerin) is preferably used. The type of biomass is not especially limited, and the biomass may be a plant biomass or an animal biomass. Among various biomass-derived materials, a plant biomass-derived material is more preferably used because such a material is easily inexpensively available in a large amount.

An example of the method for preparing glycerin from a biomass includes a method in which a vegetable oil or animal oil is hydrolyzed by a chemical method using an acid or a base, or by a biological method using an enzyme or microorganism. Alternatively, glycerin may be produced from a substrate containing saccharides such as glucose by a fermentation method. For producing the above-described alcohol (such as 1,2-propanediol or 1,3-propanediol), the glycerin obtained as described above can be used as a raw material, so as to chemically transform the glycerin into a target substance by a known method.

The binder resin is preferably a styrene acrylic-based resin synthesized from a biomass-derived acrylic acid or acrylate. The above-described glycerin can be dehydrated to give acrolein, and the resultant acrolein can be oxidized into a biomass-derived acrylic acid. Alternatively, a biomass-derived acrylate can be obtained by esterifying the biomass-derived acrylic acid by a known method. If an alcohol used in producing the acrylate is methanol or ethanol, an alcohol prepared from a biomass by a known method is preferably used.

A ratio of carbon will now be described. In $CO_2$ present in the air, the concentration of $CO_2$ containing radioactive carbon ($^{14}C$) is retained constant in the air. On the other hand, plants incorporate $CO_2$ containing $^{14}C$ from the air during photosynthesis. Therefore, the concentration of $^{14}C$ in carbon contained in an organic component of a plant is occasionally equivalent to the concentration of $CO_2$ containing $^{14}C$ in the air. The concentration of $^{14}C$ in carbon contained in an organic component of a general plant is approximately 107.5 pMC (percent Modern Carbon). Besides, carbon contained in animals is derived from carbon contained in plants. Therefore, the concentration of $^{14}C$ in carbon contained in an organic component of an animal also shows a similar tendency to that in a plant.

Here, the ratio of biomass-derived carbon in entire carbon contained in a toner can be obtained in accordance with the following Formula (1):

$$\text{Ratio of biomass-derived carbon(mass \%)}=(X/107.5)\times 100 \qquad \text{Formula (1)}$$

In Formula 1, X (pMC) represents a concentration of $^{14}C$ contained in the toner.

A plastic product containing biomass-derived carbon in a ratio of 25% by mass or more in entire carbon contained therein is particularly preferred for achieving the carbon neutral status. Such a plastic product is given a BiomassPla mark (certified by Japan BioPlastics Association). In the case where the ratio of the biomass-derived carbon in entire carbon contained in the toner is 25% by mass or more, the concentration X of $^{14}C$ in the toner obtained by Formula (1) is 26.9 pMC or more. Accordingly, in the present embodiment, the concentration of the radioactive carbon isotope $^{14}C$ in entire carbon contained in the toner is preferably set to 26.9 pMC or more in the preparation of the polyester resin. Incidentally, the concentration of $^{14}C$ in a carbon element of a petrochemical can be measured in accordance with ASTM-D6866.

In order to improve the low-temperature fixability, the glass transition point (Tg) of the binder resin is preferably equal to or lower than the curing start temperature of the thermosetting resin contained in the shell layer 120. If the glass transition point (Tg) of the binder resin falls in this range, sufficient fixability can be attained even in a rapid fixing operation. In particular, the glass transition point (Tg) of the binder resin is preferably 20° C. or more, more preferably 30° C. or more and 55° C. or less, and further more preferably 30° C. or more and 50° C. or less. If the glass transition point (Tg) of the binder resin is 20° C. or more, aggregation of the toner core 110 can be inhibited in forming the shell layer. Incidentally, the curing start temperature of a thermosetting resin is approximately 55° C.

The glass transition point (Tg) of the binder resin can be measured as follows. The glass transition point (Tg) of the binder resin can be obtained on the basis of a heat absorption curve (more specifically, a point of change in specific heat of the binder resin) obtained by measuring the heat absorption curve of the binder resin with the use of, for example, a differential scanning calorimeter (DSC) (such as "DSC-6200" manufactured by Seiko Instruments Inc.). More specifically, with 10 mg of the binder resin (measurement sample) put in an aluminum pan, and with an empty aluminum pan used as a reference, a heat absorption curve is obtained through measurement performed under conditions of a measurement temperature range from 25° C. to 200° C. inclusive and a heating rate of 10° C./min. On the basis of the thus obtained heat absorption curve of the binder resin, the glass transition point (Tg) of the binder resin is obtained.

The softening point (Tm) of the binder resin is preferably 100° C. or less, and more preferably 95° C. or less. If the softening point (Tm) is 100° C. or less, sufficient fixability can be attained even in a rapid fixing operation. For adjusting the softening point (Tm) of the binder resin, for example, a plurality of resins having different softening points (Tm) may be used in combination.

For measuring the softening point (Tm) of the binder resin, an elevated flow tester (such as "CFT-500D" manufactured by Shimadzu Corporation) can be used. Specifically, with the binder resin (measurement sample) set on the elevated flow tester, 1 $cm^3$ of the sample is melt flown under prescribed conditions (of a die diameter of 1 mm, a plunger load of 20 $kg/cm^2$, and a heating rate of 6° C./min), and thus, an S shaped curve (an S shaped curve pertaining to the temperature (° C.)/stroke (mm)) is obtained. The softening point (Tm) of the binder resin can be read from the thus obtained S shaped curve.

Figure 2:
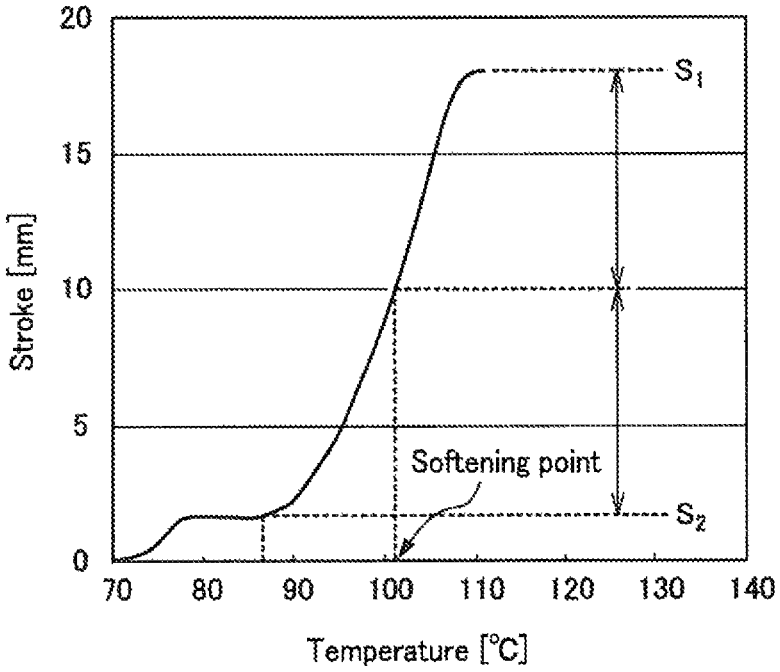
FIG. 2 is a diagram explaining a method for measuring a softening point by using an elevated flow tester.

Referring to FIG. 2, a method for reading the softening point (Tm) of the binder resin will be described. In an S shaped curve illustrated in FIG. 2, assuming that S1 represents the maximum value of the stroke and that S2 represents a stroke value corresponding to a base line on the low-temperature-side of the temperature of S1, a temperature corresponding to a stroke value of (S1+S2)/2 corresponds to the softening point (Tm) of the binder resin (measurement sample).

If the binder resin is a polyester resin, the number average molecular weight (Mn) of the polyester resin is preferably 1200 or more and 2000 or less for improving the strength of the toner core 110 and the fixability. A molecular weight distribution (i.e., a ratio between the number average molecular weight (Mn) and the mass average molecular weight (Mw); the mass average molecular weight Mw/the number average molecular weight Mn) of the polyester resin is preferably 9 or more and 20 or less for the same reason as described above.

If the binder resin is a styrene acrylic-based resin, the number average molecular weight (Mn) of the styrene acrylic-based resin is preferably 2000 or more and 3000 or less for improving the strength of the toner core 110 and the fixability. A molecular weight distribution of the styrene acrylic-based resin is preferably 10 or more and 20 or less for the same reason as described above. Incidentally, for measuring the number average molecular weight (Mn) and the mass average molecular weight (Mw) of the binder resin, gel permeation chromatography can be employed.

The toner core may contain a colorant if necessary. As the colorant, any of known pigments or dyes can be used in accordance with the color of the toner particle 100. An example of a black colorant includes carbon black. Alternatively, a colorant whose color is adjusted to black by using a colorant such as a yellow colorant, a magenta colorant, and a cyan colorant described below can be used as the black colorant.

If the toner particle 100 is a color toner, examples of the colorant contained in the toner core 110 include color colorants such as a yellow colorant, a magenta colorant, and a cyan colorant.

Examples of the yellow colorant include condensed azo compounds, isoindolinone compounds, anthraquinone compounds, azo metal complexes, methine compounds and allylamide compounds. Specific examples of the yellow colorant include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Bat Yellow.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. A specific example of the magenta colorant includes C.I. Pigment Red (2, 3, 5, 6, 7, 19, 23, 48:2, 48:3, 48:4, 57:1 81:1, 122, 144, 146, 150, 166, 169, 177, 184, 185, 202, 206, 220, 221, or 254).

Examples of the cyan colorant include copper phthalocyanine compounds, copper phthalocyanine derivatives, anthraquinone compounds, and basic dye lake compounds. Specific examples of the cyan colorant include C.I. Pigment Blue (1, 7, 15, 15:1, 15:2, 15:3, 15:4, 60, 62, or 66), phthalocyanine blue, C.I. Bat Blue, and C.I. Acid Blue.

The amount of the colorant to be used is preferably 1 part by mass or more and 20 parts by mass or less, and more preferably 3 parts by mass or more and 10 parts by mass or less based on 100 parts by mass of the binder resin.

The toner particle may contain a mold release agent if necessary. A mold release agent is used for purpose of improving the fixability or the offset resistance of the toner.

Examples of the mold release agent include aliphatic hydrocarbon-based waxes (such as low molecular weight polyethylene, low molecular weight polypropylene, polyolefin copolymers, polyolefin wax, microcrystalline wax, paraffin wax, and Fischer-Tropsch wax), oxides of the aliphatic hydrocarbon-based waxes (such as polyethylene oxide wax, and a block copolymer of polyethylene oxide wax), vegetable waxes (such as candelilla wax, carnauba wax, Japan wax, jojoba wax, and rice wax), animal waxes (such as beeswax, lanolin, and spermaceti wax), mineral waxes (such as ozokerite, ceresin, and petrolatum), waxes containing a fatty acid ester as a principal component (such as montanic acid ester wax, and castor wax), and waxes obtained by deoxidizing part or whole of fatty acid ester (such as deoxidized carnauba wax).

For improving the fixability or the offset resistance of the toner, the amount of the mold release agent to be used is preferably 1 part by mass or more and 30 parts by mass or less, and more preferably 5 parts by mass or more and 20 parts by mass or less based on 100 parts by mass of the binder resin.

A charge control agent is used for purpose of improving the charge level or the charge rising property so as to obtain a toner excellent in the durability or the stability. The charge rising property is an index whether or not the toner can be charged to prescribed charge level in a short period of time. Since the toner core 110 is anionic (negatively chargeable), a negatively chargeable charge control agent is used.

Specific examples of the negatively chargeable charge control agent include organic metal complexes and chelate compounds. Specifically, acetylacetone metal complexes (such as aluminum acetyl acetonate and iron (II) acetyl acetonate), salicylic acid-based metal complexes and salicylic acid-based metal salts (such as chromium 3,5-di-tert-butylsalicylate) are preferred, and a salicylic acid-based metal complex or a salicylic acid-based metal salt is more preferred. One of these charge control agents may be singly used, or two or more of these may be used in combination.

For improving the charge rising property, the durability, the stability or the cost merit of the toner, the amount of the negatively chargeable charge control agent to be used is preferably 0.5 part by mass or more and 20.0 parts by mass or less, and more preferably 1.0 part by mass or more and 15.0 parts by mass or less based on 100 parts by mass of the binder resin.

The toner core 110 may contain a magnetic powder if necessary. A toner including the toner particle 100 prepared by using the toner core 110 containing a magnetic powder is used as a magnetic one-component developer. Suitable examples of a material of the magnetic powder include iron (such as ferrite or magnetite); a ferromagnetic metal (such as cobalt or nickel); an alloy containing iron and/or a ferromagnetic metal; and a compound containing iron and/or a ferromagnetic metal; a ferromagnetic alloy having been ferromagnetized by heating or the like; and chromium dioxide.

The particle size of the magnetic powder is preferably 0.1 μm or more and 1.0 μm or less, and more preferably 0.1 μm or more and 0.5 μm or less. If the particle size of the magnetic powder falls in this range, the magnetic powder can be easily homogeneously dispersed in the binder resin.

The amount of the magnetic powder to be used in a toner of a one-component developer is preferably 35 parts by mass or more and 60 parts by mass or less, and more preferably 40 parts by mass or more and 60 parts by mass or less based on 100 parts by mass of the total amount of the toner. Besides, the amount of the magnetic powder to be used in a toner of a two-component developer is preferably 20 parts by mass or less, and more preferably 15 parts by mass or less based on 100 parts by mass of the total amount of the toner.

In the present embodiment, as an index of the toner core 110 having an anionic property, a zeta potential measured in an aqueous medium adjusted to pH 4 is negative. In order that the toner core 110 has a good anionic property, the zeta potential is preferably −10 mV or less.

As a method for measuring a zeta potential, for example, an electrophoresis method, an ultrasonic method, or an ESA method is employed. In the electrophoresis method, an electric field is applied to a particle dispersion for electrophoresing charged particles in the dispersion, so as to calculate a zeta potential on the basis of the electrophoretic mobility thus obtained. An example of the electrophoresis method includes a laser Doppler method. In the laser Doppler method, electrophoresing particles are irradiated with a laser beam to obtain the electrophoretic mobility on the basis of Doppler shift of scattered light thus obtained, and the zeta potential is obtained based on the electrophoretic mobility thus obtained. In the laser Doppler method, there is no need to increase the particle concentration in the dispersion, the number of parameters necessary for calculating a zeta potential is small, and the electrophoretic mobility can be highly sensitively detected.

In the ultrasonic method, a particle dispersion is irradiated with an ultrasonic wave for vibrating charged particles in the dispersion, so as to calculate a zeta potential on the basis of a potential difference caused by the vibration. In the ESA method, a high frequency voltage is applied to a particle dispersion for vibrating charged particles in the dispersion so as to cause an ultrasonic wave, and a zeta potential is calculated on the basis of the magnitude (strength) of the ultrasonic wave. In the ultrasonic method and the ESA method, a zeta potential can be highly sensitively measured even if a particle dispersion has an excessively high particle concentration (beyond, for example, 20% by mass).

As another index of the toner core 110 having an anionic property, a frictional charge amount obtained by using a standard carrier is −10 μC/g or less. The frictional charge amount serves as an index for determining whether the toner core 100 is charged positively or negatively, or an index for determining how easily the toner core 100 is charged. Incidentally, a method for obtaining a frictional charge amount obtained by the toner core 110 and the standard carrier will be described later.

The resin constituting the shell layer 120 will now be described. The resin constituting the shell layer 120 contains a thermosetting resin for improving the strength and the hardness, and for providing the shell layer with a sufficient cationic property. It is noted that a thermosetting resin has a unit in which a methylene group (—$CH_2$—) derived from formaldehyde is introduced into a monomer such as melamine in the present specification and the appended claims.

Examples of the thermosetting resin include a melamine resin, a guanamine resin, a sulfonamide resin, a urea resin, a glyoxal resin, an aniline resin, and a polyimide resin. As the thermosetting resin, one or more resins selected from an amino resin group consisting of a melamine resin, a urea resin and a glyoxal resin is preferred.

A melamine resin is a polycondensate of melamine and formaldehyde. A monomer used for forming a melamine resin is melamine. A urea resin is a polycondensate of urea and formaldehyde. A monomer used for forming a urea resin is urea. A glyoxal resin is a polycondensate of a reactant of glyoxal and urea, and formaldehyde. A monomer used for forming a glyoxal resin is a reactant of glyoxal and urea. Each of the melamine used for forming a melamine resin, the urea used for forming a urea resin, and the urea to be reacted with glyoxal may be modified by a known method. Incidentally, if the resin constituting the shell layer 120 contains a thermoplastic resin, the thermosetting resin may contain a derivative having been methylolated with formaldehyde before the reaction with the thermoplastic resin.

The shell layer 120 preferably contains a nitrogen atom derived from melamine, urea or the like. A material including a nitrogen atom is easily positively chargeable. Accordingly, in order to positively charge the toner particle 100 to a desired charge amount, the content of the nitrogen atom in the shell layer 120 is preferably 10% by mass or more.

The shell layer 120 may contain a thermoplastic resin. The thermoplastic resin may be crosslinked with a monomer of a thermosetting resin. If such a structure is employed, the shell layer 120 has not only proper flexibility due to the thermoplastic resin but also proper mechanical strength due to the three-dimensional crosslinked structure formed by the monomer of the thermosetting resin. Therefore, the shell layer 120 is not easily broken during storage or transportation at a high temperature. On the other hand, if heat and pressure are applied in a fixing operation, the shell layer 120 is easily broken. As a result, the binder resin contained in the toner core 110 is rapidly softened or molten, so that the toner can be favorably fixed on a recording medium in a low temperature region (at a temperature lower than in the traditional technique). In other words, the toner attains excellent high-temperature preservability and low-temperature fixability.

If the shell layer 120 contains a thermoplastic resin, the thermoplastic resin preferably has a functional group reactive with a functional group of the above-described thermosetting resin (such as a methylol group or an amino group). An example of the functional group reactive with the functional group of the thermosetting resin includes a functional group containing an active hydrogen atom (such as a hydroxyl group, a carboxyl group, or an amino group). An amino group may be contained in the thermoplastic resin in the form of a carbamoyl group (—$CONH_2$). As the thermoplastic resin, a resin is preferably that contains a unit derived from (meth) acrylamide, or a resin containing a unit derived from a monomer having a functional group such as a carbodiimide group, an oxazoline group, or a glycidyl group because the shell layer 120 can be easily formed when such a resin is used.

Specific examples of the thermoplastic resin that may be contained in the shell layer 120 include (meth)acrylic-based resins, styrene-(meth)acrylic-based copolymer resins, silicone-(meth)acrylic graft copolymers, polyurethane resins, polyester resins, polyvinyl alcohols, and ethylene vinyl alcohol copolymers. Such resins may contain a unit derived from a monomer having a functional group such as a carbodiimide group, an oxazoline group, or a glycidyl group. As the thermoplastic resin that may be contained in the shell layer 120, a (meth)acrylic-based resin, a styrene-(meth)acrylic-based copolymer resin, or a silicone-(meth)acrylic graft copolymer is preferred, and a (meth)acrylic-based resin is more preferred.

Examples of a (meth)acrylic monomer usable for preparing the (meth)acrylic-based resins include (meth)acrylic acid; alkyl(meth)acrylate (such as methyl(meth)acrylate, ethyl (meth)acrylate, n-propyl(meth)acrylate, or n-butyl(meth) acrylate); aryl(meth)acrylate (such as phenyl(meth)acrylate); hydroxyalkyl(meth)acrylate (such as 2-hydroxyethyl(meth) acrylate, 3-hydroxypropyl(meth)acrylate, 2-hydroxypropyl (meth)acrylate, or 4-hydroxybutyl(meth)acrylate); (meth) acrylamide; an ethylene oxide adduct of (meth)acrylic acid; and alkyl ether (such as methyl ether, ethyl ether, n-propyl ether, or n-butyl ether) of an ethylene oxide adduct of (meth) acrylic ester.

The shell layer 120 is formed preferably in an aqueous medium. This is because dissolution of the binder resin or elution of a mold release agent used as an arbitrary component is difficult to occur. Therefore, if a thermoplastic resin is used for forming the shell layer 120, the thermoplastic resin is preferably water-soluble.

If a thermoplastic resin is used for forming the shell layer 120, in order to improve the high-temperature preservability and the low-temperature fixability, a ratio (Ws/Wp), in the shell layer 120, of a content (Ws) of the thermosetting resin to a content (Wp) of the thermoplastic resin is preferably 3/7 or more and 8/2 or less, and more preferably 4/6 or more and 7/3 or less.

The thickness of the shell layer 120 is preferably 1 nm or more and 20 nm or less, and more preferably 1 nm or more and 10 nm or less. If the thickness of the shell layer 120 is 20 nm or less, the shell layer 120 can be easily broken by applying heat or pressure in fixing the toner onto a recording medium. As a result, a component of the toner such as the binder resin contained in the toner core 110 is easily rapidly softened or molten, and hence, the toner can be fixed on a recording medium in a low temperature region. Besides, since the chargeability of the shell layer 120 cannot be too high, image formation can be properly performed. On the other hand, if the thickness of the shell layer 120 is 1 nm or more, the shell layer 120 has sufficient strength, and can be inhibited from being broken by impact applied in a situation of transportation or the like. Here, if at least a part of the shell layer 120 is broken in a toner particle 100, a component such as the mold release agent is easily exuded through the broken part of the shell layer 120 onto the surface of the toner particle 100 under a high temperature condition. Therefore, if the toner is stored at a high temperature, such toner particles 100 are easily aggregated. Furthermore, if the thickness of the shell layer 120 is 1 nm or more, the chargeability cannot be too low, and hence, occurrence of an image defect can be inhibited in an image formed by using such a toner.

The thickness of the shell layer 120 can be measured by analyzing a TEM photograph image of the cross-section of the toner particle 100 by using commercially available image analysis software. As the commercially available image analysis software, "WinROOF" (manufactured by Mitani Corporation) can be used. Specifically, two straight lines are drawn to cross at substantially the center of the cross-section of the toner particle 100, and the lengths of four sections of the two straight lines crossing the shell layer 120 are measured. An average of the thus measured lengths of the four sections is defined as the thickness of the shell layer 120 of one toner particle 100 measured. Herein, this measurement of the thickness of the shell layer 120 is performed on ten or more toner particles 100, and an average of the thicknesses of the shell layers thus measured is determined as the thickness of the shell layer 120.

If the shell layer 120 is too thin, it may be difficult to measure the thickness of the shell layer 120 because the interface between the shell layer 120 and the toner core 110 is unclear on a TEM image. In such a case, the interface between the shell layer 120 and the toner core 110 may be made clear by combining a TEM image with energy dispersive X-ray spectroscopic analysis (EDX) for measuring the thickness of the shell layer 120. Specifically, mapping of an element characteristic of the material of the shell layer 120 (such as nitrogen) can be performed on a TEM image by the EDX.

The shell layer 120 may contain a charge control agent. Since the shell layer 120 is cationic (positively chargeable), a positively chargeable charge control agent can be contained. Specific examples of the positively chargeable charge control agent include an azine compound (such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, or quinoxaline), a direct dye containing an azine compound (such as azine fast red FC, azine fast red 12BK, azine violet BO, azine brown 3G, azine light brown GR, azine dark green BH/C, azine deep black EW, or azine deep black 3RL), a nigrosine compound (such as nigrosine, a nigrosine salt, or a nigrosine derivative), an acidic dye containing a nigrosine compound (such as nigrosine BK, nigrosine NB, or nigrosine Z), a metal salt of naphthenic acid, a metal salt of higher fatty acid, alkoxylated amine, alkyl amide, a quaternary ammonium salt (such as benzyldecylhexylmethyl ammonium chloride, or decyl trimethyl ammonium chloride), and a resin having, as a functional group, a quaternary ammonium salt, a carboxylate, or a carboxyl group. Among these, a nigrosine compound is preferred because a rapid rising property can be attained. One of these may be singly used, or two or more of these may be used in combination.

For improving the charge rising property, the durability, the stability or the cost merit of the toner, the amount of the positively chargeable charge control agent to be used is preferably 0.5 part by mass or more and 20.0 parts by mass or less, and more preferably 1.0 part by mass or more and 15.0 parts by mass or less based on 100 parts by mass of the resin constituting the shell layer 120.

With respect to the toner particle 100, a pH at which the zeta potential measured in an aqueous medium is zero (0) is 4.5 or higher and 7.0 or lower. In particular, a pH at which the zeta potential is zero (0) is preferably 5.0 or higher and 6.5 or lower. If this pH is 4.5 or higher, the shell layer 120 has a sufficient and uniform film thickness. Therefore, even when stored at a high temperature, the blocking is effectively suppressed in the toner. In other words, the toner is excellent in the high-temperature preservability. On the other hand, if the pH is 7.0 or lower, the shell layer 120 cannot be too thick, and hence, the shell layer 120 can be easily broken by applying heat and pressure in a fixing operation. In other words, good low-temperature fixability can be attained. Incidentally, a point where the zeta potential measured in an aqueous medium is zero (0) is herein also designated as the "isoelectric point".

The volume average particle size of the toner particle 100 is preferably 4.0 μm or more and 10.0 μm or less for improving the fixability and the handling property of the toner. Besides, the number average particle size of the toner particle 100 is preferably 3.0 μm or more and 9.0 μm or less.

Incidentally, the toner particle 100 may have a structure in which a plurality of shell layers 120 are formed on the surface of a toner core 110. In this case, at least the outermost shell layer 120 out of those formed on the toner core 110 is cationic.

Figure 3:
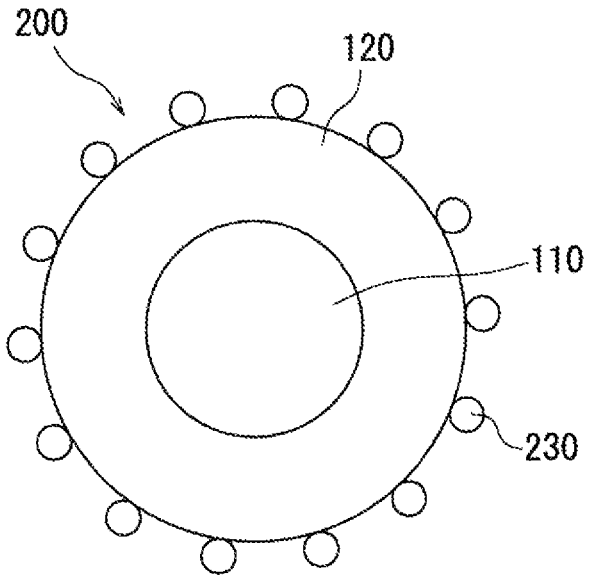
FIG. 3 is a schematic diagram of a toner particle according to another aspect included in the electrostatic latent image developing toner of the embodiment.

FIG. 3 illustrates a toner particle according to another aspect. The toner particle 200 contains a toner core 110, a shell layer 120, and an external additive 230. As illustrated in FIG. 3, the external additive 230 is attached to the surface of the toner particle 200 for improving the flowability and the handling property. As the external additive 230, particles of silica or a metal oxide (such as alumina, titanium oxide, magnesium oxide, zinc oxide, strontium titanate, or barium titanate) can be used. The particle size of the external additive 230 is preferably 0.01 μm or more and 1.0 μm or less for improving the flowability and the handling property. Incidentally, the toner particle 200 obtained before treatment with the external additive 230 is herein sometimes designated as the "toner mother particle".

For improving the flowability and the handling property, the amount of the external additive 230 to be used is preferably 1 part by mass or more and 10 parts by mass or less, and more preferably 2 parts by mass or more and 5 parts by mass or less based on 100 parts by mass of the toner mother particle.

The toner can be mixed with a desired carrier to be used as a two-component developer. The carrier is preferably a magnetic carrier. An example of the carrier includes a carrier in which a carrier core is coated with a resin. Specific examples of the carrier core include a particle of a material such as iron, oxidized iron, reduced iron, magnetite, copper, silicon steel, ferrite, nickel, or cobalt, or a particle of an alloy of such a material and a metal such as manganese, zinc, or aluminum; a particle of an iron-nickel alloy or an iron-cobalt alloy; a particle of a ceramic such as titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate; and a particle of a high-dielectric constant material such as ammonium dihydrogen phosphate, potassium dihydrogen phosphate, or Rochelle salt. Alternatively, a resin carrier in which any of the above-described particle (magnetic particle) is dispersed in a resin can be used as the carrier core.

Examples of the resin coating the carrier core include (meth)acrylic-based polymers, styrene-based polymers, styrene-(meth)acrylic-based copolymers, olefin-based polymers (such as polyethylene, chlorinated polyethylene, and polypropylene), polyvinyl chloride, polyvinyl acetate, polycarbonate, cellulose resins, polyester resins, unsaturated polyester resins, polyamide resins, polyurethane resins, epoxy resins, silicone resins, fluorine resins (such as polytetrafluoroethylene, polychlorotrifluoroethylene, and polyvinylidene fluoride), phenol resins, xylene resins, diallyl phthalate resins, polyacetal resins, and amino resins. One of these resins may be singly used, or two or more of these may be used in combination.

The particle size of the carrier measured by using an electron microscope is preferably 20 μm or more and 120 μm or less, and more preferably 25 μm or more and 80 μm or less for improving the magnetic property or the flowability to be attained when the toner is used as a two-component developer.

If the toner is used as a two-component developer, for improving the magnetic property and the fixability, the amount of the toner to be contained in the two-component developer is preferably 3% by mass or more and 20% by mass or less, and more preferably 5% by mass or more and 15% by mass or less based on the mass of the two-component developer.

Now, a method for producing an electrostatic latent image developing toner of the present embodiment will be described. The method for producing an electrostatic latent image developing toner of the present embodiment includes the steps of: preparing a toner core 110 containing a binder resin (a toner core preparing step); and coating the toner core 110 with a shell layer 120 (a shell layer forming step). Through the toner core preparing step and the shell layer forming step, the toner core 110 is coated with the shell layer 120 to obtain the toner particle 100, and thus, a toner containing this toner particle 100 can be produced.

The zeta potential of the toner core 110 measured in an aqueous medium adjusted to pH 4 is preferably negative. If the shell layer 120 is formed on the surface of the toner core 110 in an aqueous medium, there is a tendency that the shell layer 120 cannot be uniformly formed unless the toner core 110 is highly dispersed in the aqueous medium containing a dispersant. If the toner core 110 has such an anionic property as to show this zeta potential, however, it is presumed that the thermosetting resin positively charged in the aqueous medium is electrically drawn to the toner core 110 negatively charged in the aqueous medium. Then, the shell layer 120 is formed on the surface of the toner core 110 negatively charged in the aqueous medium. Therefore, the shell layer 120 can be easily uniformly formed on the surface of the toner core 110 without highly dispersing the toner core 110 in the aqueous medium by using a dispersant.

A dispersant has extremely high wastewater load. Since a dispersant is not used, however, it is presumed that the total organic carbon concentration of wastewater drained in the production of the toner particle 100 can be at a low level (of, for example, 15 mg/L or less) without diluting the wastewater.

For executing the toner core preparing step, a method in which a component other than the binder resin (such as a colorant, a charge control agent, a mold release agent, or a magnetic powder) used if necessary can be satisfactorily dispersed in the binder resin is employed. Specific examples of such a method include an aggregation method and a melt kneading method (pulverization method).

The toner core preparing step performed by the melt kneading method will now be described. The toner core preparing step performed by the melt kneading method includes a mixing process, a melt kneading process, a pulverizing process, and a classifying process. In the mixing process, the binder resin and a component other than the binder resin used if necessary are mixed to obtain a mixture. In the melt kneading process, the obtained mixture is melt kneaded to obtain a melt kneaded product. In the pulverizing process, the obtained melt kneaded product is appropriately solidified by cooling or the like, and the resultant is pulverized by a known method to obtain a pulverized product. In the classifying process, the obtained pulverized product is classified by a known method to obtain the toner core 110 having a desired particle size.

The toner core preparing step performed by the aggregation method will now be described. The toner core preparing step performed by the aggregation method includes an aggregating process and a coalescing process.

In the aggregating process, fine particles containing components of the toner core 110 are aggregated in an aqueous medium to form aggregated particles. Then, in the coalescing process, the components contained in the aggregated particles are coalesced in the aqueous medium to form the toner core 110.

In the aggregating process, fine particles containing components of the toner core 110 are first prepared. The fine particles containing the components of the toner core 110 may contain the binder resin, and a component other than the binder resin (such as a colorant, a mold release agent, or a charge control agent) used if necessary.

For example, the binder resin (or a composition containing the binder resin) is micronized to a desired size in an aqueous medium, so as to prepare an aqueous dispersion (a resin dispersion) containing the fine particles including the binder resin (resin fine particles). The resin dispersion may contain an aqueous dispersion including fine particles of a component other than the binder resin (such as a colorant dispersion or a release agent dispersion). In the aggregating process, the fine particles are aggregated in such a resin dispersion to obtain the aggregated particles.

Now, a preparation method for the resin dispersion (a preparation method 1), a preparation method for the release agent dispersion (a preparation method 2), and a preparation method for a colorant dispersion (a preparation method 3) will be successively described.

In the preparation method 1, first, the binder resin and another component are primarily pulverized by using a pulverizer such as a turbo mill. Subsequently, the resulting primarily pulverized product is dispersed in an aqueous medium such as ion-exchanged water, and the resultant dispersion is heated. Then, a strong shearing force is applied by using a high-speed shearing emulsifier (such as "Clearmix" (manufactured by M Technique Co., Ltd.)), so as to obtain the resin dispersion. The heating temperature is preferably equal to or higher than a temperature higher by 10° C. than the softening point (Tm) of the binder resin (i.e., Tm+10° C.), and equal to or lower than 200° C.

The volume average particle size of the resin fine particles is preferably 1 μm or less, and more preferably 0.05 μm or more and 0.5 μm or less. If the volume average particle size of the resin fine particles falls in this range, the toner core 110 having a sharp particle size distribution and a uniform shape can be easily prepared. The volume average particle size can be measured by using a laser diffraction particle size analyzer (such as "SALD-2200" manufactured by Shimadzu Corporation).

The resin dispersion may contain a surfactant. If a surfactant is used, the resin fine particles can be easily stably dispersed in the aqueous medium.

Examples of the surfactant include an anionic surfactant, a cationic surfactant, and a nonionic surfactant. Examples of the anionic surfactant include a sulfuric acid ester salt type surfactant, a sulfonic acid salt type surfactant, a phosphoric acid ester salt type surfactant, and soap. Examples of the cationic surfactant include an amine salt type surfactant and a quaternary ammonium salt type surfactant. Examples of the nonionic surfactant include a polyethylene glycol type surfactant, an alkylphenol ethylene oxide adduct type surfactant, and a polyvalent alcohol type surfactant (a derivative of a polyvalent alcohol such as glycerin, sorbitol, or sorbitan). As the surfactant, an anionic surfactant is preferably used. One of these surfactants may be singly used, or two or more of these may be used in combination.

The amount of the surfactant to be used is preferably 0.01% by mass or more and 10% by mass or less based on the mass of the binder resin for improving the dispersibility of the fine particles.

In using a resin having an acidic group as the binder resin, if the binder resin is directly micronized in an aqueous medium, the specific surface area of the binder resin is increased. Therefore, the pH of the aqueous medium may be lowered to approximately 3 or higher and 4 or lower due to the influence of the acidic group exposed on the surface of the fine particles containing the binder resin. If the pH of the aqueous medium is lowered to approximately 3 or higher and 4 or lower, the binder resin may be hydrolyzed, or the fine particles containing the binder resin may not be micronized to a desired particle size.

In order to inhibit the aforementioned problem, a basic substance may be added to the aqueous medium in the preparation method 1. The basic substance is not limited as long the above-described problem can be inhibited, and specific examples of the basic substance include an alkali metal hydroxide (such as sodium hydroxide, potassium hydroxide, or lithium hydroxide), an alkali metal carbonate (such as sodium carbonate or potassium carbonate), an alkali metal hydrogencarbonate (such as sodium hydrogencarbonate or potassium hydrogencarbonate), and a nitrogen-containing organic base (such as N,N-dimethylethanolamine, N,N-diethylethanolamine, triethanolamine, tripropanolamine, tributanolamine, triethylamine, n-propylamine, n-butylamine, isopropylamine, monomethanolamine, morpholine, methoxypropylamine, pyridine, or vinylpyridine).

In the preparation method 2, first, a mold release agent is precedently pulverized into a size of approximately 100 μm or less to obtain a powder of the mold release agent. For preparing the fine particles of the mold release agent, the powder of the mold release agent is preferably added to an aqueous medium containing a surfactant to prepare a slurry. The amount of the surfactant to be used is preferably 0.01% by mass or more and 10% by mass or less based on the mass of the mold release agent for improving the dispersibility of the fine particles.

Next, the obtained slurry is heated to a temperature equal to or higher than the melting point of the mold release agent. To the heated slurry, a strong shearing force is applied by using a homogenizer (such as "Ultra-Turrax T50" manufactured by IKA) or a pressure-ejecting type disperser, so as to prepare an aqueous dispersion containing the mold release agent fine particles (a release agent dispersion). Examples of the apparatus for applying a strong shearing force to the dispersion include "NANO3000" (manufactured by Beryu Co., Ltd.), "Nanomizer" (manufactured by Yoshida Kikai Co., Ltd.), "Microfluidizer" (manufactured by MFI), "Gaulin Homogenizer" (manufactured by Manton Gaulin), and "Clearmix W Motion" (manufactured by M Technique Co., Ltd).

The volume average particle size of the mold release agent fine particles contained in the release agent dispersion is preferably 1 μm or less, more preferably 0.1 μm or more and 0.7 μm or less, and further more preferably 0.28 μm or more and 0.55 μm or less. If the mold release agent fine particles having a volume average particle size of 1 μm or less are used, the mold release agent can be easily homogeneously dispersed in the binder resin in the resultant toner particle. The volume average particle size of the mold release agent fine particles can be measured by a method similar to that employed for measuring the volume average particle size of the binder resin fine particles.

In the preparation method 3, a colorant, and an arbitrary component such as a dispersant for the colorant used if necessary are subjected to a dispersion treatment in an aqueous medium containing a surfactant by using a known disperser. Thus, an aqueous dispersion (colorant dispersion) containing the fine particles of the colorant is prepared. As the surfactant, the surfactant used for preparing the fine particles of the binder resin described above can be used. The amount of the surfactant to be used is preferably 0.01 part by mass or more and 10 parts by mass or less based on 100 parts by mass of the colorant for improving the dispersibility of the fine particles.

Examples of the disperser used for the dispersion treatment include a pressure disperser and a medium type disperser. Examples of the pressure disperser include an ultrasonic disperser, a mechanical homogenizer, Manton Gaulin, a pressure homogenizer, and a high-pressure homogenizer (manufactured by Yoshida Kikai Co., Ltd). Examples of the medium type disperser include a sand grinder, a horizontal or vertical bead mill, "Ultra Apex Mill" (manufactured by Kotobuki Industries Co., Ltd.), "Dyno Mill" (manufactured by WAB Company), and "MSC mill" (manufactured by Nippon Coke and Engineering Co., Ltd).

The volume average particle size of the colorant fine particles is 0.01 μm or more and 0.2 μm or less. The volume average particle size of the colorant fine particles can be measured by a method similar to that employed for measuring the volume average particle size of the binder resin fine particles.

Then, the release agent dispersion and/or the colorant dispersion are appropriately combined and mixed with the resin dispersion prepared as described above as necessary, so that the resultant toner core 110 can contain desired components to obtain a mixed dispersion. In the thus obtained mixed dispersion, these fine particles are aggregated, so as to obtain an aqueous dispersion including the aggregated particles containing the binder resin.

A suitable method for aggregating the fine particles in the aggregating process is performed, for example, as follows. After adjusting the pH of the aqueous dispersion containing the resin fine particles, an aggregating agent is added to the resin dispersion. Subsequently, the temperature of the resin dispersion is adjusted to a prescribed temperature to aggregate the fine particles.

Examples of the aggregating agent include an inorganic metal salt, an inorganic ammonium salt, and a bivalent or higher valent metal complex. Examples of the inorganic metal salt include a metal salt (such as sodium sulfate, sodium chloride, calcium chloride, calcium nitrate, barium chloride, magnesium chloride, zinc chloride, aluminum chloride, or aluminum sulfate), and an inorganic metal salt polymer (such as polyaluminum chloride or polyaluminum hydroxide). Examples of the inorganic aluminum salt include ammonium sulfate, ammonium chloride, and ammonium nitrate. Alternatively, a quaternary ammonium salt type cationic surfactant, or a nitrogen-containing compound (such as polyethyleneimine) can be used as the aggregating agent.

As the aggregating agent, a bivalent metal salt or a monovalent metal salt is preferably used. One of these aggregating agents may be singly used, or two or more of these may be used in combination. If two or more aggregating agents are used in combination, a bivalent metal salt and a monovalent metal salt are preferably used together. This is because a bivalent metal salt and a monovalent metal salt are different in the speed of aggregating the fine particles, and therefore, when they are used together, a particle size distribution of the aggregated particles can be easily made sharp while inhibiting increase of the particle size of the resulting aggregated particles.

In the aggregating process, the pH of the aqueous dispersion in adding the aggregating agent is preferably adjusted to 8 or higher. The aggregating agent may be added at one time, or may be gradually added.

In order to satisfactorily aggregate the fine particles, the amount of the aggregating agent to be added is preferably 1 part by mass or more and 50 parts by mass or less based on 100 parts by mass of a solid content of the aqueous dispersion. The amount of the aggregating agent to be added can be appropriately adjusted in accordance with the type and amount of dispersant contained in the fine particle dispersion.

In the aggregating process, the temperature of the aqueous dispersion in aggregating the fine particles is preferably equal to or higher than the glass transition point (Tg) of the binder resin, and lower than a temperature higher by 10° C. than the glass transition point of the binder resin (i.e., Tg+10° C.). If the aqueous dispersion is set to such a temperature, the fine particles contained in the aqueous dispersion can be satisfactorily aggregated.

After the aggregation has proceeded to attain a desired particle size of the aggregated particles, an aggregation terminator may be added thereto. Examples of the aggregation terminator include sodium chloride, potassium chloride, and magnesium chloride.

In the coalescing process, the components contained in the aggregated particles obtained in the aggregating process are coalesced in the aqueous medium, so as to form the toner core 110. For coalescing the components of the aggregated particles, the aggregation dispersion obtained by the aggregating process is heated. Thus, an aqueous dispersion containing the toner core 110 can be obtained.

In the coalescing process, the heating temperature for the aqueous dispersion containing the aggregated particles is preferably equal to or higher than the temperature higher by 10° C. than the glass transition point (Tg) of the binder resin (i.e., Tg+10° C.) and equal to or lower than the melting point of the binder resin. When the heating temperature for the aqueous dispersion falls in the above-described range, the components contained in the aggregated particles can be satisfactorily coalesced.

The aqueous dispersion containing the toner core 110 resulting from the coalescing process can be subjected, if necessary, to a washing process and a drying process described below.

In the washing process, the toner core 110 obtained as described above is washed with, for example, water. As a washing method, for example, the toner core 110 is solid-liquid separated from the aqueous dispersion containing the toner core 110 to collect the toner core 110 in the form of a wet cake, and the thus obtained wet cake is washed with water. Alternatively, as another washing method, the toner core 110 contained in the aqueous dispersion is precipitated, the supernatant is exchanged with water, and the toner core 110 is dispersed again in water after the exchange.

In the drying process, the toner core resulting from the washing process is dried by using, for example, a dryer (such as a spray dryer, a fluidized-bed dryer, a vacuum freeze dryer, or a vacuum dryer).

The toner core preparing step has been described in detail so far. Subsequently, the shell layer forming step will be described. In the shell layer forming step, the shell layer 120 is formed on the surface of the toner core 110 prepared as described above, so as to produce the toner particle 100 in which the toner core 110 is coated with the shell layer 120.

The shell layer 120 is formed by reacting, for example, a monomer of a thermosetting resin (such as melamine, urea, or a reactant of glyoxal and urea), and a monomer derived from a thermoplastic resin or the like used together if necessary. Alternatively, a precursor produced by an addition reaction of a monomer of a thermosetting resin and formaldehyde (a methylolated product) may be used instead of a monomer of a thermosetting resin. The shell layer 120 is formed preferably in a solvent such as water. If a solvent such as water is used, the dissolution of the binder resin into the solvent or the elution of a component such as the mold release agent contained in the toner core 110 can be inhibited.

In the shell layer forming step, in order to form the shell layer 120, a material for forming the shell layer 120 is preferably added to the aqueous dispersion containing the toner core 110 for dispersing the material therein. Examples of a method for satisfactorily dispersing the toner core 110 in an aqueous dispersion include a method in which the toner core 110 is mechanically dispersed by using an apparatus capable of strongly stirring the dispersion; and a method in which the toner core 110 is dispersed in the aqueous medium by using a dispersant. If the method using a dispersant is employed, the toner core 110 can be homogeneously dispersed in the aqueous medium, and hence, the shell layer 120 can be easily uniformly formed.

An example of the apparatus capable of strongly stirring the dispersion includes "HIVIS MIX" (manufactured by Primix Corporation).

Examples of the dispersant to be used for dispersing the toner core 110 in the aqueous medium include sodium polyacrylate, poly(paravinylphenol), partially saponificated polyvinyl acetate, isoprene sulfonic acid, polyether, an isobutylene/maleic anhydride copolymer, sodium polyaspartate, starch, gelatin, acacia gum, polyvinyl pyrrolidone, and sodium lignosulfonate. One of these dispersants may be singly used, or two or more of these may be used in combination.

The amount of the dispersant to be used is preferably 75 parts by mass or less based on 100 parts by mass of the toner core 110. If the amount of the dispersant to be used is 75 parts by mass or less, the total organic carbon concentration in the resultant wastewater can be reduced.

Besides, if the dispersant is used in forming the shell layer 120, the toner core 110 can be easily uniformly coated with the shell layer 120 as described above. On the other hand, since the dispersant adheres to the surface of the toner core 110, the dispersant is contained in the interface between the toner core 110 and the shell layer 120. Therefore, the attaching force of the shell layer 120 to the toner core 110 is weakened by the influence of the dispersant present on the interface, and hence, the shell layer 120 is easily peeled off from the toner core 110 when mechanical stress is applied to the toner. Here, if the amount of the dispersant to be used is 75 parts by mass or less, the peeling of the shell layer 120 off from the toner core 110 can be inhibited.

The pH of the aqueous medium containing the toner core 110 is preferably adjusted to about 4 by using an acidic substance before forming the shell layer. When the pH of the dispersion is thus adjusted on the acidic side, condensation polymerization of the material used for forming the shell layer 120 is accelerated.

After adjusting the pH of the aqueous dispersion containing the toner core 110 as occasion demands, the material for forming the shell layer 120 may be dissolved in the aqueous dispersion containing the toner core 110. Thereafter, the material for forming the shell layer 120 is reacted on the surface of the toner core in the aqueous dispersion, so that the shell layer 120 coating the surface of the toner core 110 can be formed.

The temperature at which the shell layer forming step is performed is preferably 40° C. or more and 95° C. or less, and more preferably 50° C. or more and 80° C. or less. If the temperature for performing the shell layer forming step is 40° C. or more and 95° C. or less, the shell layer 120 is satisfactorily formed.

In the case where the binder resin includes a resin having a hydroxyl group or a carboxyl group (such as a polyester resin), if the shell layer 120 is formed at a temperature of 40° C. or more and 95° C. or less, the hydroxyl group or carboxyl group exposed on the surface of the toner core 110 is reacted with a methylol group of the thermosetting resin. Through this reaction, a covalent bond is formed between the binder resin constituting the toner core 110 and the resin constituting the shell layer 120, and hence, the shell layer 120 can be easily strongly attached to the toner core 110.

After forming the shell layer 120, the aqueous dispersion containing the toner core coated with the shell layer 120 is cooled to ordinary temperature, and thus, a dispersion of the toner particles 100 (or the toner mother particles) can be obtained. Thereafter, for example, a washing process, a drying process and an external addition process are performed, and the toner particles 100 are collected from the dispersion of the toner particles 100. It is noted that the washing process, the drying process and the external addition process may be appropriately omitted. The thus obtained toner particles 100 may be used as an electrostatic latent image developing toner, or may be mixed with another component for obtaining an electrostatic latent image developing toner.

In the washing process, the toner particles 100 (the toner mother particles) are washed with water. As a suitable washing method for the toner particles 100, for example, the toner particles 100 are solid-liquid separated from the aqueous dispersion containing the toner particles 100, so as to collect the toner mother particles in the form of a wet cake, and the thus obtained wet cake is washed with water. Alternatively, as another suitable washing method for the toner mother particles, the toner particles 100 contained in the aqueous dispersion are precipitated, the supernatant is exchanged with water, and the toner particles 100 (the toner mother particles) are dispersed again in water after the exchange.

In the drying process, the toner particles 100 (the toner mother particles) collected or washed as described above are dried by using, for example, a dryer (such as a spray dryer, a fluidized-bed dryer, a vacuum freeze dryer, or a vacuum dryer). A spray dryer is preferably used for inhibiting aggregation of the toner particles 100 during the drying process. If a spray dryer is used, the external addition process described later can be simultaneously performed by spraying a dispersion of an external additive (such as silica fine particles) together with the dispersion of the toner particles 100.

In the external addition process, an external additive is attached to the surface of the toner particles 100 (the toner mother particles). As a suitable method for attaching the external additive, for example, the toner mother particles and the external additive are mixed by using a mixer (such as an FM mixer, or a Nauta mixer) under conditions where the external additive is not buried in a surface portion of each toner mother particle.

The electrostatic latent image developing toner according to the present embodiment described so far with reference to FIGS. 1 to 3 is excellent in both the high-temperature preservability and the low-temperature fixability. Therefore, the electrostatic latent image developing toner can be suitably used in an image forming apparatus in which, for example, an electrophotographic method, an electrostatic recording method, or an electrostatic printing method is applied.

EXAMPLES

The present disclosure will now be described more specifically with reference to examples. It is noted that the present disclosure is not limited to the scope of these examples.

Preparation Example 1

Preparation of Toner Core a by Melt Kneading Method

First, a polyester resin A was obtained as follows: To a 5 L four-necked flask, 1245 g of terephthalic acid, 1245 g of isophthalic acid, 1248 g of an ethylene oxide adduct of bisphenol A, and 744 g of ethylene glycol were added. The atmosphere inside the flask was replaced with nitrogen, and the temperature inside the flask was increased to 250° C. under stirring. Subsequently, a reaction was performed at ordinary pressure and 250° C. for 4 hours. Thereafter, 0.875 g of antimony trioxide, 0.548 g of triphenyl phosphate, and 0.102 g of tetrabutyl titanate were added to the flask. Then, the pressure inside the flask was reduced to 0.3 mmHg, and the temperature inside the flask was increased to 280° C. Subsequently, the content of the flask was reacted at 280° C. for 6 hours to obtain a polyester resin having a number average molecular weight of 13,000. Then, 30.0 g of trimellitic acid was added as a crosslinking agent to the flask, the pressure inside the flask was restored to ordinary pressure, and the temperature inside the flask was lowered to 270° C. Thereafter, the content of the flask was reacted at ordinary pressure and 270° C. for 1 hour. After completing the reaction, the content of the flask was taken out and cooled, and thus, a polyester resin A was obtained. As for the physical properties of the polyester resin A, the number average molecular weight (Mn) was 1,295, the mass average molecular weight (Mw) was 14,500, the molecular weight distribution (the mass average molecular weight Mw/the number average molecular weight Mn) was 11.2, the hydroxyl value was 20 mgKOH/g, the acid value was 40 mgKOH/g, the softening point (Tm) was 100° C., and the glass transition point (Tg) was 48° C.

A hundred (100) parts by mass of the polyester resin A, 5 parts by mass of a colorant (C.I. Pigment Blue 15:3, copper phthalocyanine), and 5 parts by mass of a mold release agent (an ester wax, "WEP-3" manufactured by NOF Corporation) were mixed by using a mixer (FM mixer) to obtain a mixture (the mixing process). The thus obtained mixture was melt kneaded by using a two screw extruder ("PCM-30" manufactured by Ikegai Corporation) (the melt kneading process). The resulting kneaded product was pulverized by using a mechanical pulverizer ("Turbo Mill" manufactured by Freund Turbo Corporation) (the pulverizing process). The resultant was classified by a classifier ("Elbow Jet" manufactured by Nittetsu Mining Co., Ltd.) (the classifying process). In this manner, a toner core A having a volume average particle size of 6.0 μm, a number average particle size of 5.0 μm, and roundness of 0.93 was obtained.

With respect to the toner core A, a frictional charge amount obtained by using a standard carrier was −20 μC/g, and a zeta potential obtained in a dispersion at pH 4 was −15 mV. In other words, the toner core A clearly showed an anionic property. Besides, the softening point (Tm) of the toner core A was 90° C., and the glass transition point (Tg) thereof was 49° C.

Preparation Example 2

Preparation of Toner Core B by Aggregation Method

First, a resin dispersion A was prepared. As a binder resin, a polyester resin B having the following monomer composition was used:

Monomer Composition (in Molar Ratio):

polyoxypropylene(2,2)-2,2-bis(4-hydroxyphenyl)propane/polyoxyethylene(2,0)-2,2-bis(4-hydroxyphenyl)propane/fumaric acid/trimellitic acid=25/25/46/4

As for the physical properties of the polyester resin B, the number average molecular weight (Mn) was 2,500, the mass average molecular weight (Mw) was 6,500, the molecular weight distribution (the mass average molecular weight Mw/the number average molecular weight Mn) was 2.6, the softening point (Tm) was 91° C., the glass transition point (Tg) was 51° C., the acid value was 15.5 mgKOH/g, and the hydroxyl value was 45.5 mgKOH/g.

The polyester resin B was primarily pulverized by using "Turbo Mill T250" (manufactured by Freund Turbo Corporation) to obtain a primarily pulverized product (with an average particle size of approximately 10 μm). A hundred (100) g of the thus obtained primarily pulverized product, 2 g of an anionic surfactant ("Emal E-27C" manufactured by Kao Corporation, sodium polyoxyethylene lauryl ether sulfate), and 50 g of 0.1N-sodium hydroxide aqueous solution (corresponding to a basic substance) were mixed, and ion-exchanged water was further added thereto as an aqueous medium, and thus, a slurry in a total amount of 500 g was prepared.

The thus obtained slurry was put in a pressure round bottom stainless steel vessel. Subsequently, by using a high-speed shearing emulsifier, "Clearmix" ("CLM-2.2S" manufactured by M Technique Co., Ltd.), the slurry was shear dispersed at a rotor rotational speed of 20,000 rpm for 30 minutes under application of a temperature of 145° C. and a pressure of 0.5 MPa (G). After the shear dispersion, while cooling the slurry at a rate of 5° C./min, the slurry was continuously stirred at a rotor rotational speed of 15,000 rpm until the temperature inside the stainless steel vessel was lowered to 50° C. Thereafter, the slurry was cooled to ordinary temperature at a rate of 5° C./min. To the slurry thus cooled to ordinary temperature, ion-exchanged water was added so that a solid content concentration in the mass of the dispersion could be 10% by mass, and thus, a resin dispersion A in which fine particles of the polyester resin B were dispersed was obtained. The average particle size of the fine particles of the polyester resin B in the resin dispersion A was approximately 140 nm. For measuring the particle size, a particle size distribution measuring device ("Microtrac UPA150" manufactured by Nikkiso Co., Ltd.) was used.

Next, a release agent dispersion A was prepared as follows: Two hundred (200) g of a mold release agent ("WEP-5" manufactured by NOF Corporation, pentaerythritol behenic acid ester wax, having a melting temperature of 84° C.), 2 g of an anionic surfactant ("Emal E-27C" manufactured by Kao Corporation), and 800 g of ion-exchanged water were mixed. Subsequently, the resultant mixed solution was heated to 100° C. for melting the mold release agent. Thereafter, the resultant was emulsified by using a homogenizer ("Ultra-Turrax T50" manufactured by IKA) for 5 minutes. Then, an emulsification treatment was performed by using "Gaulin Homogenizer" (manufactured by Manton Gaulin) at 100° C. In this manner, a release agent dispersion having an average particle size of 250 nm, a melting point of 83° C., and a solid content concentration of 20% by mass was obtained.

Next, a colorant dispersion A was prepared as follows: Ninety (90) g of a cyan colorant (C.I. Pigment Blue 15:3, copper phthalocyanine), 10 g of an anionic surfactant ("Emal 0" manufactured by Kao Corporation, sodium lauryl sulfate), and 400 g of ion-exchanged water were mixed. The resulting mixture was emulsified and dispersed for 1 hour by using a high-pressure impact disperser "Ultimizer" ("HJP30006" manufactured by Sugino Machine Ltd.). Thus, a colorant dispersion having a solid content concentration of 18% by mass was obtained.

The particle size distribution of colorant fine particles contained in the colorant dispersion A thus obtained was measured by using a particle size distribution measuring device ("Microtrac UPS150" manufactured by Nikkiso Co., Ltd.). The volume average particle size of the colorant fine particles contained in the colorant dispersion A was 160 nm, and its particle size distribution had a Cv value of 25%. It was confirmed, based on a TEM image of the colorant fine particles, that the colorant fine particles had roundness of 0.800.

Next, the following three dispersions were used in the following ratio, and a dispersion containing the toner core B was prepared as described below. Thereafter, the dispersion was subjected to aggregation (the aggregating process).

Resin dispersion A (with a solid content concentration of 10% by mass): 213 g

Release agent dispersion A (with a solid content concentration of 20% by mass): 12.5 g Colorant dispersion A (with a solid content concentration of 18% by mass): 7 g A temperature sensor, a condenser tube, and a stirrer were set on a 1 L four-necked flask. Then, the three dispersions described above, 0.2 g of an anionic surfactant ("Emal 0" manufactured by Kao Corporation), and 270 g of ion-exchanged water were put in the flask and stirred at a stirring speed of 200 rpm. Thereafter, the content of the flask was adjusted to pH 9 by using triethanolamine.

Subsequently, an aqueous solution of 4.0 g of a magnesium chloride hexahydrate (used as an aggregating agent) dissolved in 4.0 g of ion-exchanged water was added to the flask. After allowing the resultant dispersion to stand still in the flask for 5 minutes, the temperature inside the flask was increased to 50° C. at a rate of 5° C./min. Thereafter, the temperature inside the flask was increased to 73° C. at a rate of 0.5° C./min. Subsequently, with the temperature of the dispersion kept at 73° C., the fine particles contained in the dispersion were aggregated.

The following process corresponds to the coalescing process. When the aggregated particles contained in the dispersion attained a volume average particle size of 6.5 μm, 29.3 g of sodium chloride (used as an aggregation terminator) was added thereto, and the resulting dispersion was stirred at a stirring speed of 350 rpm for 10 minutes. After the stirring, the resulting dispersion was cooled to room temperature at a rate of 5° C./min.

Subsequently, after adjusting the pH of the dispersion to 2 by adding 1N-hydrochloric acid thereto, the toner core B was collected by filtration. The toner core B was washed by adding 1 L of water to the collected toner core B, followed by stirring and filtering the resultant again. This washing operation was repeated, and after a dispersion in which 2 g the collected toner core B was dispersed in 20 g of water attained conductivity of 10 μS/cm or less, the toner core B was dried by allowing it to stand still under an atmosphere of 40° C. for 48 hours. As for the physical properties of the toner core B, the volume average particle size was 6.6 μm, the number average particle size was 5.7 μm, the roundness was 0.94, and the frictional charge amount obtained by using a standard carrier was −10 μC/g. Incidentally, the conductivity of the dispersion was measured by using "ES-51" (manufactured by Horiba Ltd.). The zeta potential of the toner core B, which was measured in preparing the dispersion of pH 4 by the aforementioned method, was −15 mV.

Preparation Example 3

Preparation of Toner Core C by Aggregation Method

First, a resin dispersion B containing fine particles of a binder resin (a styrene acrylic-based resin) was prepared by performing suspension polymerization as follows. As for the properties of the styrene acrylic-based resin, the number average molecular weight (Mn) was 5,400, the mass average molecular weight (Mw) was 18,000, the molecular weight distribution (the mass average molecular weight Mw/the number average molecular weight Mn) was 3.3, the softening point (Tm) was 91° C., and the glass transition point (Tg) was 46° C.

To a 1000 mL four-necked flask equipped with a stirrer, a condenser tube, a nitrogen introducing tube, and a temperature sensor, 550 mL of distilled water, and 0.35 g of an anionic surfactant ("Emal 0" manufactured by Kao Corporation, sodium lauryl sulfate) were added. After heating the content of the flask to 80° C. with stirring under nitrogen stream, 81 g of a potassium persulfate aqueous solution (in a concentration of 2.5% by mass) was added to the flask. Furthermore, a monomer mixed solution containing 89 g of styrene, 58 g of n-butyl acrylate, 14 g of methacrylic acid, and 3.3 g of n-octyl mercaptan was added, by using a dropping funnel, dropwise to the flask over 1.5 hours. After the dropwise addition, polymerization was performed at 80° C. for 2 hours under stirring of a reaction solution. After completing the polymerization, the content of the flask was cooled to room temperature, and distilled water was added to the flask so as to attain a solid content concentration of 10% by mass. In this manner, a resin dispersion B in which fine particles (with an average particle size of approximately 90 nm) of the styrene acrylic-based resin were dispersed was obtained.

The following three dispersions were used for preparing a dispersion containing the toner core C as described below. The thus obtained dispersion was subjected to the aggregating process.

Resin dispersion B (with a solid content concentration of 10% by mass): 213 g

Release agent dispersion A (with a solid content concentration of 20% by mass): 12.5 g Colorant dispersion A (with a solid content concentration of 18% by mass): 7 g A temperature sensor, a condenser tube, and a stirrer were set on a 1 L four-necked flask. Then, the three dispersions described above, 0.2 g of an anionic surfactant ("Emal 0" manufactured by Kao Corporation), and 270 g of ion-exchanged water were put in the flask and stirred at a stirring speed of 200 rpm. Thereafter, the content of the flask was adjusted to pH 10 by using triethanolamine, and then, an aqueous solution of 4.0 g of a magnesium chloride hexahydrate (used as an aggregating agent) dissolved in 4.0 g of ion-exchanged water was added to the flask. The resultant dispersion was allowed to stand still in the flask for 5 minutes. Subsequently, the temperature inside the flask was increased to 50° C. at a rate of 5° C./min. Thereafter, the temperature inside the flask was increased to 73° C. at a rate of 0.5° C./min Subsequently, with the temperature of the dispersion kept at 73° C., the fine particles contained in the dispersion were aggregated.

The following process corresponds to the coalescing process. When the aggregated particles contained in the dispersion attained a volume average particle size of 6.5 μm, 29.3 g of sodium chloride (used as an aggregation terminator) was added thereto. Subsequently, the resulting dispersion was stirred at a stirring speed of 350 rpm for 10 minutes. After the stirring, the resulting dispersion was cooled to room temperature at a rate of 5° C./min, and thus, a dispersion containing the toner core C was obtained.

The toner core C was collected from the thus obtained dispersion of the toner core C in the same manner as in the collection of the toner core B. As for the physical properties of the toner core C, the volume average particle size was 6.8 μm, the number average particle size was 5.9 μm, the roundness was 0.94, and the frictional charge amount attained by using a standard carrier was −15 μC/g. Besides, the zeta potential of the toner core C measured in a dispersion of pH 4 was −12 mV.

Example 1

The shell layer forming step was performed on the toner core A as follows:

To a 1 L three-necked flask equipped with a thermometer and a stirring blade, 300 mL of ion-exchanged water was added. Subsequently, the temperature inside the flask was kept at 30° C. by using a water bath. Then, dilute hydrochloric acid was added to the flask to adjust the aqueous medium obtained in the flask to pH 4. Thereafter, 1 mL of a methylol melamine aqueous solution ("Mirben resin SM-607" manufactured by Showa Denko K.K., having a solid content concentration of 80% by mass) was added as a material of a shell layer (a shell material) to the flask. Then, the content of the flask was stirred to dissolve the material of the shell layer in the aqueous medium. Thus, an aqueous solution A of the material of the shell layer was obtained.

To the aqueous solution A, 150 g of the toner core A was added, and the resultant content of the flask was stirred at a speed of 200 rpm for 1 hour. Subsequently, 150 mL of ion-exchanged water was added to the flask. Thereafter, while stirring the content of the flask at 100 rpm, the temperature inside the flask was increased to 70° C. (that is, a shell layer forming temperature) at a rate of 1° C./min. Then, the content of the flask was continuously stirred for 2 hours under conditions of 70° C. and 100 rpm. Thereafter, sodium hydroxide was added thereto to adjust the content of the flask to pH 7. Subsequently, the content of the flask was cooled to ordinary temperature. Thus, a dispersion containing toner particles (toner mother particles) was obtained.

The washing process was executed as follows. A wet cake of the toner particles was filtered out by using a Buchner funnel from the dispersion containing the toner particles. Then, the wet cake of the toner particles is dispersed again in ion-exchanged water, so as to wash the toner particles. This filtration and dispersion was repeated five times for washing the toner particles. Incidentally, the filtrate of the dispersion containing the toner particles, and washing water used in the washing process were collected as wastewater.

The drying process was executed as follows. When a dispersion in which 2 g of the collected toner particles were dispersed in 20 g of water attained conductivity of 10 μS/cm or less, the collected toner particles were dried by allowing them to stand still for 48 hours under an atmosphere of 40° C. The toner particles resulting from the drying process were used as an electrostatic latent image developing toner.

Examples 2 to 5

Electrostatic latent image developing toners of Examples 2 to 5 were obtained in the same manner as in Example 1 except that the amount of "Mirben resin SM-607" (manufactured by Showa Denko K.K.) added in the aqueous solution A was changed respectively to 2.0 mL, 0.5 mL, 3.0 mL, and 10.0 mL.

Example 6

An electrostatic latent image developing toner of Example 6 was obtained in the same manner as in Example 1 except that the toner core B was used instead of the toner core A.

Example 7

An electrostatic latent image developing toner of Example 7 was obtained in the same manner as in Example 1 except that the toner core C was used instead of the toner core A.

Example 8

An electrostatic latent image developing toner of Example 8 was obtained in the same manner as in Example 1 except that "Mirben resin SM-607" used in the aqueous solution A was replaced with an aqueous solution containing another thermosetting resin monomer ("SM650" manufactured by Showa Denko K.K., having a solid content concentration of 80% by mass) used in an amount of 10 mL.

Example 9

An electrostatic latent image developing toner of Example 9 was obtained in the same manner as in Example 1 except that "Mirben resin SM-607" used in the aqueous solution A was replaced with an aqueous solution containing another thermosetting resin monomer ("NF-9" manufactured by Showa Denko K.K., having a solid content concentration of 80% by mass) used in an amount of 0.5 mL.

Comparative Example 1

The toner core A prepared without forming the shell layer was obtained as an electrostatic latent image developing toner of Comparative Example 1.

Comparative Example 2

An electrostatic latent image developing toner of Comparative Example 2 was obtained in the same manner as in Example 1 except that the amount of "Mirben resin SM-607" (manufactured by Showa Denko K.K.) used in the aqueous solution A was changed to 0.3 mL.

Comparative Example 3

An electrostatic latent image developing toner of Comparative Example 3 was obtained in the same manner as in Example 1 except that 150 g of the ion-exchanged water was adjusted to pH 2.

Comparative Example 4

An electrostatic latent image developing toner of Comparative Example 4 was obtained in the same manner as in Example 1 except that the amount of "Mirben resin SM-607" (manufactured by Showa Denko K.K.) used in the aqueous solution A was changed to 12 mL.

Comparative Example 5

An electrostatic latent image developing toner of Comparative Example 5 was obtained in the same manner as in Example 1 except that "Mirben resin SM-607" used in the aqueous solution A was replaced with "SM650" (manufactured by Showa Denko K.K.) used in an amount of 0.3 mL.

Comparative Example 6

An electrostatic latent image developing toner of Comparative Example 6 was obtained in the same manner as in Example 1 except that "Mirben resin SM-607" used in the aqueous solution A was replaced with "NF-9" (manufactured by Showa Denko K.K.) used in an amount of 12 mL.

The measurement methods and evaluation methods for the electrostatic latent image developing toners obtained in these examples and comparative examples are as follows:

(1) Frictional Charge Amount Obtained by Toner Core and Standard Carrier

A standard carrier N-01 (a standard carrier for a negatively chargeable toner available from The Imaging Society of Japan), and each of the toner cores in an amount of 7% by mass based on the mass of the standard carrier were mixed for 30 minutes by using a Turbula mixer. The thus obtained mixture was used as a measurement sample. With respect to each measurement sample, the frictional charge amount of the toner core attained by friction with the standard carrier was measured by using a QM meter ("MODEL 210HS-2A" manufactured by TREK Inc.).

(2) Zeta Potential of Toner Core in Dispersion Adjusted to pH 4

A magnet stirrer was used for mixing 0.2 g of each toner core, 80 g of ion-exchanged water, and 20 g of a 1 mass % nonionic surfactant (polyvinyl pyrrolidone, "K-85" manufactured by Nippon Shokubai Co., Ltd.). Thus, a dispersion was obtained by homogeneously dispersing the toner core. Subsequently, dilute hydrochloric acid was added to the dispersion to adjust the dispersion to pH 4. The dispersion thus adjusted to pH 4 was used as a measurement sample. The zeta potential of the toner core contained in the measurement sample was measured by using a zeta potential-particle size analyzer ("Delsa Nano HC" manufactured by Beckman Coulter).

(3) pH of Toner Particles at Isoelectric Point

The laser Doppler method was employed for measuring the pH of the toner particles at the isoelectric point at 23° C. by using, as a measurement apparatus, "ELSZ-1000" (manufactured by Otsuka Electronics Co., Ltd.). A measurement sample was prepared as follows: To 100 g of water in which a nonionic surfactant ("Emuigen 120" manufactured by Kao Corporation) was dissolved in a concentration of 0.1% by mass, 1 g of the toner particles were added. The resultant was subjected to an ultrasonic treatment for 3 minutes to obtain a toner particle dispersion. This toner particle dispersion was used as a measurement sample. Then, dilute hydrochloric acid was added to the measurement sample to adjust the dispersion to the lowest pH value in a measurable range of pH and was measured. Thereafter, a 1N-sodium hydroxide aqueous solution was added dropwise to the toner particle dispersion for gradually increasing the pH value. A zeta potential was measured every time a desired pH value was stably obtained, and thus, the pH at the isoelectric point was obtained.

(4) Particle Sizes (Volume Average Particle Size and Number Average Particle Size) of Particles The particle sizes were measured by using "Coulter Counter Multisizer 3" (manufactured by Beckman Coulter).

(5) Roundness of Particles

The roundness of 3000 particles of each type of the particles was measured by using a flow type particle image analyzer ("FPIA (registered trademark of Japan) 3000" manufactured by Sysmex Corporation), and an average of the measured roundness was determined as the roundness of that type of the particles.

(6) High-Temperature Preservability (Degree of Aggregation)

Two (2) g of each toner was weighed in a 20 mL plastic vessel, and the resultant was allowed to stand still for 3 hours in a thermostat heated at 60° C. Thus, a toner for high-temperature preservability evaluation was obtained. Then, the toner for high-temperature preservability evaluation was sifted by using a 100 mesh sieve (having an opening of 150 μm) in accordance with an instruction manual of a powder tester (manufactured by Hosokawa Micron K.K.) under conditions of a rheostat scale of 5 and time of 30 seconds. After sifting, the mass of the toner remaining on the sieve was measured. On the basis of the mass of the toner before sifting and the mass of the toner remaining on the sieve after sifting, a degree of aggregation (% by mass) was obtained in accordance with the following formula, and the high-temperature preservability was evaluated in accordance with the following criteria:

Degree of aggregation (% by mass)=(Mass of toner remaining on sieve/mass of toner before sifting)×100

G (Good): The degree of aggregation was 20% by mass or less.

P (Poor): The degree of aggregation exceeded 20% by mass.

(7) Low-Temperature Fixability (Lowest Fixing Temperature)

First, a two-component developer was prepared as follows: To 100 parts by mass of the toner particles obtained in each of the examples and the comparative examples, 1 part by mass of hydrophobic silica fine particles ("RA-200H" manufactured by Nippon Aerosil Co., Ltd.) and 0.5 part by mass of titanium oxide ("ST-100" manufactured by Titan Kogyo Ltd.) were added as an external additive. These components were mixed by using an FM mixer ("FM-20B" manufactured by Nippon Coke and Engineering Co., Ltd.) to obtain a toner containing the external additive. Subsequently, a carrier was obtained as follows: Twenty (20) parts by mass of a silicone resin ("KR-271" manufactured by Shin-Etsu Chemical Co., Ltd.) was dissolved in 200 parts by mass of toluene to give a coating solution. The coating solution was spray coated onto 1000 parts by mass of a carrier core ("EF-35" manufactured by Powdertech Co., Ltd.) by using a fluidized-bed coating apparatus. Thereafter, the resultant was heated at 200° C. for 60 minutes to give a carrier. Then, 10 parts by mass of the toner containing the external additive and 100 parts by mass of the carrier were mixed for 30 minutes by using a ball mill, and thus, a two-component developer was prepared. Then, as an evaluation apparatus, a printer ("FS-C5250DN" manufactured by Kyocera Document Solutions Inc.) modified so that a fixing temperature could be adjusted was used. The two-component developer prepared as described above was supplied to a developing unit. Thereafter, any one of the toners obtained in the examples and the comparative examples was supplied to a toner container of the evaluation apparatus. Under conditions of a linear speed of 200 mm/sec and a toner placement amount of 1.0 mg/cm$^2$, an unfixed solid image was formed on a recording medium. With the measurement range for the fixing temperature set to 100 to 200° C. inclusive, and with the fixing temperature of a fixing unit of the evaluation apparatus increased from 100° C. in increments of 5° C., the unfixed solid image was fixed. Thus, a lowest temperature (a lowest fixing temperature) at which the solid image could be fixed on the recording medium without offset was measured. The low-temperature fixability was evaluated in accordance with the following criteria:

G (Good): The lowest fixing temperature was 160° C. or less.

P (Poor): The lowest fixing temperature exceeded 160° C.

(8) Thickness of Shell Layer

The toner particles obtained in each of the examples and the comparative examples were dispersed in a cold-setting epoxy resin, and the resultant was allowed to stand still in an atmosphere of 40° C. for 2 days for curing, so as to obtain a cured substance. Subsequently, the cured substance was dyed with osmium tetroxide. Thereafter, a thin sample with a thickness of 200 nm was cut out from the resultant cured substance by using a microtome ("EM UC6" manufactured by Leica Microsystems). A photograph of the cross-section of the thus obtained thin sample was taken by using a transmission electron microscope (TEM) ("JSM-6700 F" manufactured by JEOL Ltd.).

The thickness of the shell layer was measured by analyzing the TEM photograph image thus taken by using image analysis software ("WinROOF" manufactured by Mitani Corporation). Specifically, two straight lines were drawn to cross at substantially the center of the cross-section of the toner particle, and the lengths of four sections of the two straight lines crossing the shell layer were measured. An average of the thus measured lengths of the four sections was defined as the thickness of the shell layer of that toner particle measured. This measurement of the thickness of the shell layer was performed on ten toner particles, and an average of the thicknesses of the shell layers of the toner particles thus measured was determined as the thickness of the shell layer.

Incidentally, if the thickness of the shell layer is smaller than 5 nm, it is sometimes difficult to measure the thickness based on a TEM image alone as described above. In such a case, a TEM photograph image and the energy dispersive X-ray spectroscopic analysis (EDX) were both employed for performing mapping of a nitrogen element, so that the thickness of the shell layer could be measured.

Table 1 shows the evaluation results of all the electrostatic latent image developing toners obtained in the examples and the comparative examples.

TABLE 1

| | Volume average particle size (μm) | Number average particle size (μm) | Roundness | Zeta potential at pH 4 (mV) | pH at isoelectric point | Shell layer thickness (nm) | High-temperature Preservability (%) | High-temperature Preservability Eval. | Low-temperature Fixability (° C.) | Low-temperature Fixability Eval. |
|---|---|---|---|---|---|---|---|---|---|---|
| Example 1 | 6.0 | 4.8 | 0.97 | 30 mV | 5.1 | 2 | 15 | G | 150 | G |
| Example 2 | 6.0 | 4.8 | 0.98 | 35 mV | 6.4 | 4 | 8 | G | 155 | G |
| Example 3 | 6.1 | 4.7 | 0.98 | 25 mV | 4.6 | 1 | 18 | G | 145 | G |
| Example 4 | 6.1 | 4.8 | 0.97 | 35 mV | 5.5 | 6 | 10 | G | 155 | G |
| Example 5 | 6.7 | 5.8 | 0.97 | 20 mV | 5.2 | 2 | 13 | G | 150 | G |

TABLE 1-continued

| | Volume average particle size (μm) | Number average particle size (μm) | Round-ness | Zeta potential at pH 4 (mV) | pH at isoelectric point | Shell layer thick-ness (nm) | High-temperature Preservability (%) | Eval. | Low-temperature Fixability (° C.) | Eval. |
|---|---|---|---|---|---|---|---|---|---|---|
| Example 6 | 6.8 | 6.0 | 0.97 | 25 mV | 5.3 | 2 | 11 | G | 155 | G |
| Example 7 | 6.1 | 4.8 | 0.97 | 35 mV | 7.0 | 20 | 5 | G | 160 | G |
| Example 8 | 6.1 | 4.8 | 0.97 | 33 mV | 6.9 | 20 | 4 | G | 160 | G |
| Example 9 | 6.1 | 4.8 | 0.97 | 26 mV | 4.5 | 1 | 17 | G | 145 | G |
| Com. Example 1 | 6.0 | 4.7 | 0.93 | −15 mV | unmeasurable | 0 | 98 | P | 135 | G |
| Com. Example 2 | 6.1 | 4.7 | 0.97 | 4 mV | 4.2 | 0.6 | 25 | P | 150 | G |
| Com. Example 3 | 6.1 | 4.7 | 0.97 | 10 mV | 4.3 | 0.8 | 23 | P | 155 | G |
| Com. Example 4 | 6.1 | 4.8 | 0.97 | 35 mV | 7.5 | 24 | 3 | G | 165 | P |
| Com. Example 5 | 6.1 | 4.8 | 0.97 | 4 mV | 4.2 | 0.6 | 27 | P | 150 | G |
| Com. Example 6 | 6.1 | 4.8 | 0.97 | 37 mV | 7.6 | 24 | 3 | G | 165 | P |

As is obvious from Table 1, the electrostatic latent image developing toners obtained in Examples 1 to 9 were excellent in the high-temperature preservability and the low-temperature fixability.

In the electrostatic latent image developing toner obtained in Comparative Example 1, the high-temperature preservability was insufficient because no shell layer was formed.

In the electrostatic latent image developing toners obtained in Comparative Examples 2, 3, and 5, the high-temperature preservability was insufficient because the pH at which the zeta potential was zero was lower than 4.5, and the thickness of the shell layer was excessively small.

In the electrostatic latent image developing toners obtained in Comparative Examples 4 and 6, the low-temperature fixability was insufficient because the pH at which the zeta potential was zero exceeded 7, and the thickness of the shell layer was excessively large.

What is claimed is:

1. An electrostatic latent image developing toner comprising a toner particle including a toner core containing a binder resin, and a shell layer coating a surface of the toner core, wherein the shell layer is constituted by a resin containing a thermosetting resin, the shell layer has a thickness of 1 nm or more and 20 nm or less, a zeta potential of the toner core measured in an aqueous medium adjusted to pH 4 is negative, a zeta potential of the toner particle measured in an aqueous medium adjusted to pH 4 is positive, and a pH at which the zeta potential of the toner particle measured in an aqueous medium is zero is 4.5 or higher and 7.0 or lower.

2. An electrostatic latent image developing toner according to claim 1, wherein a glass transition point of the binder resin is equal to or lower than a curing start temperature of the resin constituting the shell layer.

3. An electrostatic latent image developing toner according to claim 1, wherein a softening point of the binder resin is 100° C. or less.

4. An electrostatic latent image developing toner according to claim 1, wherein the thermosetting resin is one or more resins selected from an amino resin group consisting of a melamine resin, a urea resin, and a glyoxal resin.

5. An electrostatic latent image developing toner according to claim 1, wherein a content of a nitrogen atom in the shell layer is 10% by mass or more.

6. An electrostatic latent image developing toner according to claim 1, wherein a solubility parameter of the binder resin is 10 or more.

7. An electrostatic latent image developing toner according to claim 1, wherein the shell layer has a thickness of 1 nm or more and 6 nm or less.

8. An electrostatic latent image developing toner according to claim 1, wherein the shell layer contains no dispersant.

9. An electrostatic latent image developing toner according to claim 1, wherein a zeta potential of the toner particle measured in an aqueous medium adjusted to pH 4 is 20 mV or more.

* * * * *